US006949987B2

(12) United States Patent
Suzuki et al.

(10) Patent No.: US 6,949,987 B2
(45) Date of Patent: Sep. 27, 2005

(54) DIELECTRIC ELECTRONIC COMPONENT WITH ATTENUATION ADJUSTMENT ELECTRODE AND METHOD OF ADJUSTING ATTENUATION CHARACTERISTICS OF THE SAME

(75) Inventors: Hidefumi Suzuki, Mie (JP); Yukihiro Hamaguchi, Mie (JP); Shoji Ono, Mie (JP)

(73) Assignee: NGK Spark Plug Co., LTD, Nagoya (JP)

( * ) Notice: Subject to any disclaimer, the term of this patent is extended or adjusted under 35 U.S.C. 154(b) by 148 days.

(21) Appl. No.: 10/397,273

(22) Filed: Mar. 27, 2003

(65) Prior Publication Data

US 2003/0184409 A1 Oct. 2, 2003

(30) Foreign Application Priority Data

Mar. 29, 2002 (JP) ..... 2002-097458

(51) Int. Cl.[7] ..... H01P 5/12
(52) U.S. Cl. ..... 333/134; 333/202; 333/206
(58) Field of Search ..... 333/134, 202, 333/206, 207

(56) References Cited

U.S. PATENT DOCUMENTS 5,502,422 A 3/1996 Newell et al. ..... 333/207
6,498,543 B2 * 12/2002 Kim et al. ..... 333/134
2002/0109562 A1 8/2002 Tsukamoto et al. ..... 333/134

FOREIGN PATENT DOCUMENTS

| | | |
|---|---|---|
| EP | 1 087 457 A2 | 3/2001 |
| EP | 1 291 957 A2 | 3/2003 |
| GB | 2 249 220 A | 4/1992 |
| JP | 2001-160701 | 6/2001 |
| WO | WO 93/14532 | 7/1993 |
| WO | WO 01/11709 A1 | 2/2001 |

* cited by examiner

*Primary Examiner*—Quan Tra
(74) *Attorney, Agent, or Firm*—Stites & Harbison PLLC; Ross F. Hunt, Jr.

(57) ABSTRACT

A dielectric electronic component such as a dielectric duplexer includes a dielectric ceramic block, a plurality of resonators arranged in a row in the dielectric ceramic block, and at least one terminal pad formed on a side surface of the dielectric ceramic block and coupled to a selected one of the resonators. An attenuation adjustment electrode is provided on an end face of the dielectric ceramic block in the vicinity of the selected resonator. The attenuation adjustment electrode has a base conductor portion extending from the terminal pad and having an edge that faces the end of the selected resonator, and first and second adjustment conductor portions projecting from the base conductor portion and directly oppositely along a general path or direction defined by the arrangement of the resonators. The first and second adjustment conductor portions are selectively ground away in order to adjust the frequency of the attenuation peak of the frequency characteristics of the component.

14 Claims, 6 Drawing Sheets

DIELECTRIC ELECTRONIC COMPONENT WITH ATTENUATION ADJUSTMENT ELECTRODE AND METHOD OF ADJUSTING ATTENUATION CHARACTERISTICS OF THE SAME

BACKGROUND OF THE INVENTION

1. Field of the Invention

The present invention relates to dielectric electronic components, such as a dielectric filter or a dielectric duplexer, which are used in mobile communication devices such as cellular phones, and which include a plurality of resonators arranged in a row.

2. Description of Related Art

A dielectric duplexer, which is an example of a dielectric electronic component of the type referred to above, is typically configured in the following manner. A plurality of resonators are arranged in a row in a dielectric ceramic block. Each of the resonators is formed through coating, with an internal conductor, the inner wall surface of a through-hole formed in the dielectric ceramic block. A predetermined circumferential surface of the dielectric ceramic block is coated with an external conductor. The resonators are divided into two groups. One group serves as a transmission section which is coupled with an input terminal pad formed on the predetermined circumferential surface in spaced relation to the external conductor. The other group serves as a receiver or reception section which is coupled with an output terminal pad formed on the predetermined circumferential surface in spaced relation to the external conductor. An antenna terminal pad is formed on a mounting surface of the dielectric duplexer in spaced relation to the external conductor in such a manner as to be coupled with the innermost resonator of the transmission section and the innermost resonator of the reception section.

A dielectric filter is another example of a dielectric electronic component of the type of interest here.

Conventional dielectric electronic components having the above-described configuration suffer the disadvantage that the attenuation characteristics thereof vary substantially from component to component. This is due to various factors such as variations involved in molding of the associated dielectric ceramic blocks which preclude obtaining the desired attenuation characteristics. Further, with the advancement and diversification of mobile communication devices, an increased demand has arisen for dielectric electronic components, such as dielectric filters and dielectric duplexers, which have various different attenuation characteristics.

SUMMARY OF THE INVENTION

In view of the foregoing, an object of the present invention is to provide a dielectric electronic component, such as dielectric filter or dielectric duplexer, having attenuation characteristics which can be easily adjusted.

Another object of the present invention is to provide a method of adjusting the attenuation characteristics of a dielectric electronic component which enables easy adjustment of these characteristics.

In order to achieve the above objects, there is provided, in accordance with one aspect of the present invention, a dielectric electronic component comprising: a dielectric ceramic block; a plurality of resonators arranged in a row in the dielectric ceramic block, each of said resonators comprising an internal conductor covering a wall surface of a through-hole formed in the dielectric ceramic block; an external conductor covering a side surface of the dielectric ceramic block; at least one terminal pad formed on the side surface of the dielectric ceramic block in spaced relation to the external conductor and coupled with a selected or predetermined resonator of the plurality of resonators; and an attenuation-characteristic adjustment electrode (hereinafter referred to as an "attenuation adjustment electrode") provided on an end face of the dielectric ceramic block, said end face providing an open circuit end for the resonators, and said attenuation adjustment electrode being located in the vicinity of, i.e., in adjacent spaced relation to, one end of the selected resonator, the attenuation adjustment electrode including a base conductor portion extending from the terminal pad and having an edge that faces the one end of the selected resonator, and at least one adjustment conductor portion projecting from the base conductor portion generally along the path or direction defined by the arrangement of resonators, i.e., substantially laterally of the base conductor.

Experiments performed by the present inventors have determined that when the attenuation adjustment electrode is selectively reduced in size, preferably by grinding away or otherwise removing at least part of the adjustment conduction portion thereof, the degree of coupling between the terminal pad and the selected resonator changes, and thus the attenuation characteristics of the dielectric electronic component change. Accordingly, the structure of the dielectric electronic component in which the attenuation adjustment electrode includes such an adjustment conductor portion enables easy adjustment of the attenuation characteristics of the dielectric electronic component.

The present inventors have further found that the attenuation characteristics change in a different manner depending on the location of a portion of the adjustment conductor portion that has been ground away. In view of this discovery, the present invention provides a dielectric electronic component which has the above-described configuration and in which the attenuation adjustment electrode has first and second adjustment conductor portions projecting substantially laterally from the base conductor portion in such a manner that the first adjustment conductor portion extends toward a center part of the end face of the block, and the second adjustment conductor portion extends toward an outside part of the end face of the block.

In the embodiment described above, when the first adjustment conductor portion is ground away or otherwise removed, the attenuation peak is shifted toward the lower frequency side, and when the second adjustment conductor portion is ground away or otherwise removed, the attenuation peak is shifted toward the higher frequency side. Since the above-described configuration enables easy determination of the amount of grinding and the positioning of the associated grinding tool that are required for obtaining the desired attenuation characteristics, the attenuation characteristics can be quickly adjusted as desired.

In a preferred embodiment the selected resonator has a circular extension conductor provided at one end of the selected resonator and connected thereto, and the base conductor portion of the attenuation adjustment electrode has an arcuate edge concentric with the circular extension conductor.

In accordance with a further aspect of the present invention there is provided a method of adjusting attenuation characteristics of a dielectric electronic component having the above-described configuration. The method comprises the step of grinding away or otherwise removing the adjustment conductor portion of the attenuation adjustment electrode to thereby adjust the attenuation characteristics.

In accordance with yet another aspect of the present invention, there is further provided a method of adjusting attenuation characteristics of a dielectric electronic component which has the above-described configuration and in which the attenuation adjustment electrode has first and second adjustment conductor portions projecting from the base conductor portion substantially laterally thereof in such a manner that the first adjustment conductor portion extends toward a center part of the end face of the block, and the second adjustment conductor portion extends toward an outside part of the end face of the block. The method comprises the steps of grinding away or otherwise removing the first adjustment conductor portion in order to shift an attenuation peak toward the lower frequency side, and grinding away or otherwise removing the second adjustment conductor portion in order to shift the attenuation peak toward the higher frequency side.

This method enables quick and proper adjustment of the attenuation characteristics.

According to a further aspect of the present invention, there is provided a dielectric duplexer comprising: a dielectric ceramic block; a plurality of resonators arranged in a row in the dielectric ceramic block, the resonators each comprising an internal conductor disposed on or covering a wall surface of a through-hole formed in the dielectric ceramic block, and being divided into first and second groups such that the first group serves as a transmission section and the second group serves as a reception section; an external conductor covering a side surface of the dielectric ceramic block; an input terminal pad formed on the side surface of the dielectric ceramic block in spaced relation to the external conductor and so as to be coupled with the transmission section; an output terminal pad formed on the side surface of the dielectric ceramic block in spaced relation to the external conductor and so as to be coupled with the reception section; an antenna terminal pad formed on the side surface of the dielectric ceramic block in spaced relation to the external conductor and so as to be coupled with an innermost resonator of the transmission section and an innermost resonator of the reception section; and an attenuation adjustment electrode provided on an end face of the dielectric ceramic block, the end face providing an open circuit end for the resonators of the reception section, and the attenuation adjustment electrode being located in the vicinity of one end of an outermost resonator of the reception section, the attenuation adjustment electrode including a base conductor portion extending from the output terminal pad and having an edge that faces the one end of the outermost resonator, and at least one adjustment conductor portion projecting from the base conductor portion substantially laterally thereof.

Preferably, the attenuation adjustment electrode has first and second adjustment conductor portions projecting substantially laterally from the base conductor portion in opposite directions in such a manner that the first adjustment conductor portion extends toward a center part of the end face of the block, and the second adjustment conductor portion extends toward an outside part of the end face of the block.

The outermost resonator of the reception section preferably includes a circular extension conductor provided at the one end of the outermost resonator and connected thereto, and the base conductor portion of the attenuation adjustment electrode preferably has an arcuate edge concentric with the circular extension conductor.

The present invention further concerns a method of adjusting attenuation characteristics of a dielectric duplexer having the above-described configuration. The method comprises the step of grinding away or otherwise removing the adjustment conductor portion of the attenuation adjustment electrode to thereby adjust the attenuation characteristics.

The present invention further concerns a method of adjusting attenuation characteristics of a dielectric duplexer which has the above-described configuration and in which the attenuation adjustment electrode includes first and second adjustment conductor portions projecting substantially laterally from the base conductor portion in such a manner that the first adjustment conductor portion extends toward a center part of the end face of the block, and the second adjustment conductor portion extends toward an outside part of the end face of the block. The method comprises the steps of grinding away or otherwise removing the first adjustment conductor portion in order to shift an attenuation peak toward the lower frequency side, and grinding away or otherwise removing the second adjustment conductor portion in order to shift the attenuation peak toward the higher frequency side. Again, this method enables quick and proper adjustment of the attenuation characteristics.

Further features and advantages of the present invention will be set forth in, or apparent from, the detailed description of preferred embodiments thereof which follows.

BRIEF DESCRIPTION OF THE DRAWINGS

FIGS. 4A and 4B are schematic views of an attenuation adjustment electrode after having been modified so as to reduce the size thereof, wherein FIG. 4A shows a case where a first adjustment conductor portion has been ground away, and FIG. 4B shows a case where a second adjustment conductor portion has been ground way;

FIGS. 5A and 5B are graphs showing attenuation characteristics of the dielectric duplexer, wherein FIG. 5A shows the attenuation characteristics in the case where the first adjustment conductor portion has been ground away, and FIG. 5B shows the attenuation characteristics in the case where the attenuation adjustment electrode is undisturbed, i.e., has not been ground at away all; and FIGS. 6A and 6B are graphs showing attenuation characteristics of the dielectric duplexer, wherein FIG. 6A shows the attenuation characteristics in the case where the second adjustment conductor portion has been ground away, and FIG. 6B shows the attenuation characteristics in the case where the attenuation adjustment electrode is undisturbed, i.e., has not been ground away at all.

DESCRIPTION OF THE PREFERRED EMBODIMENTS

The present invention will next be described while a dielectric duplexer is taken as an example.

Figure 1:
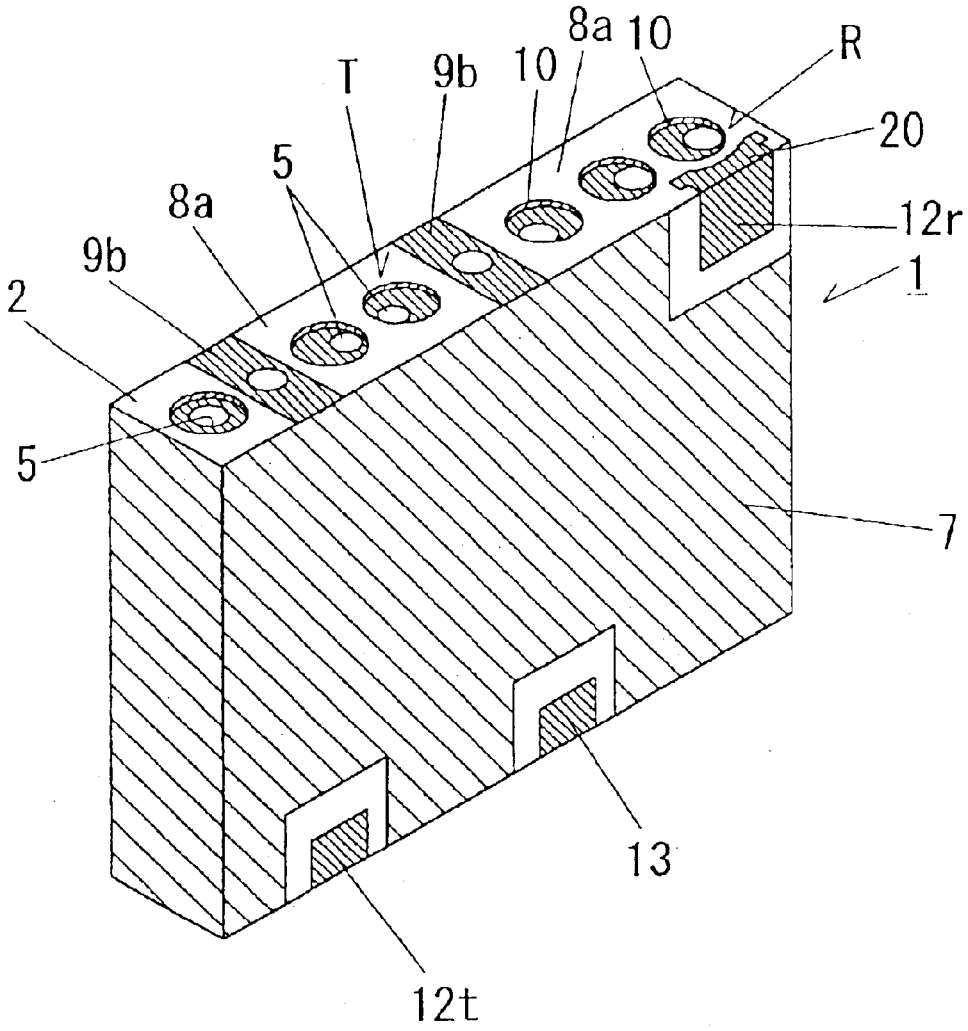
FIG. 1 is a perspective view of a dielectric duplexer according to a preferred embodiment of the present invention.
Figure 2:
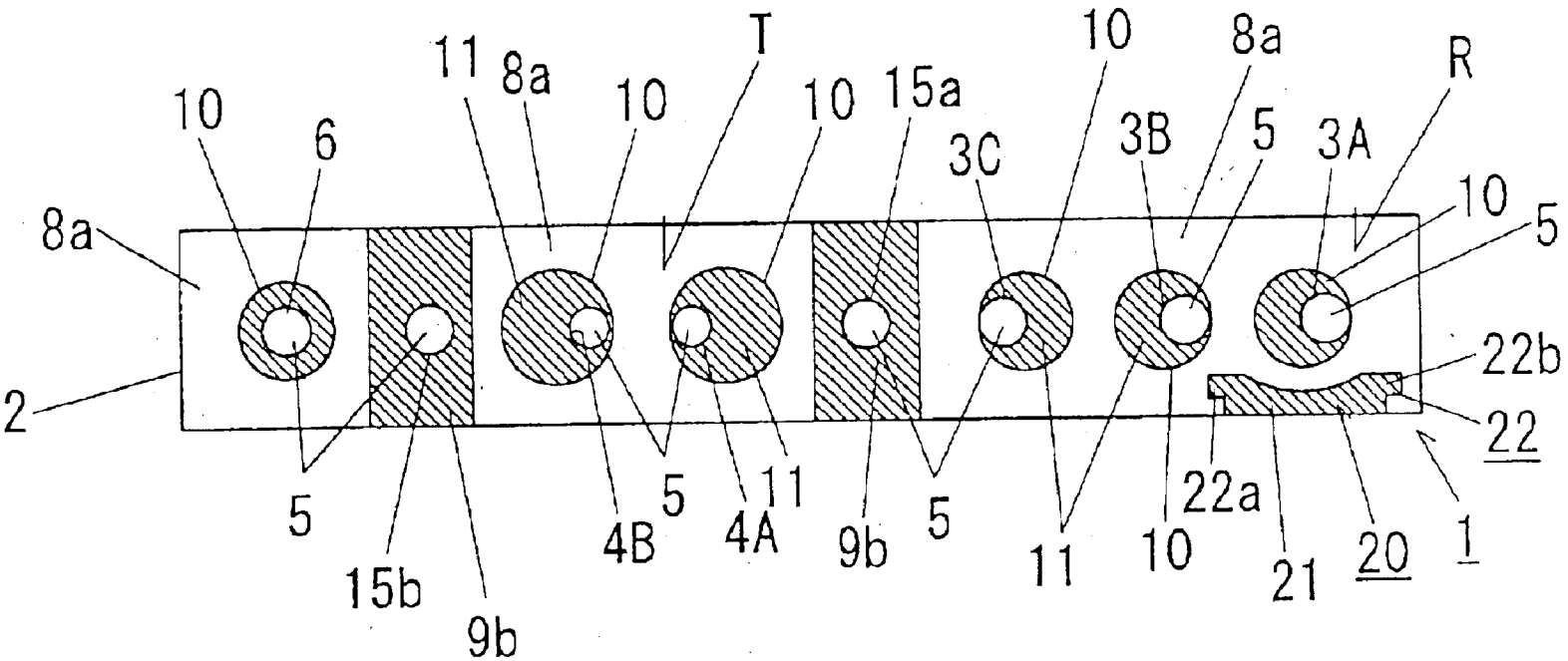
FIG. 2 is a top view of the dielectric duplexer of FIG. 1.
Figure 3:
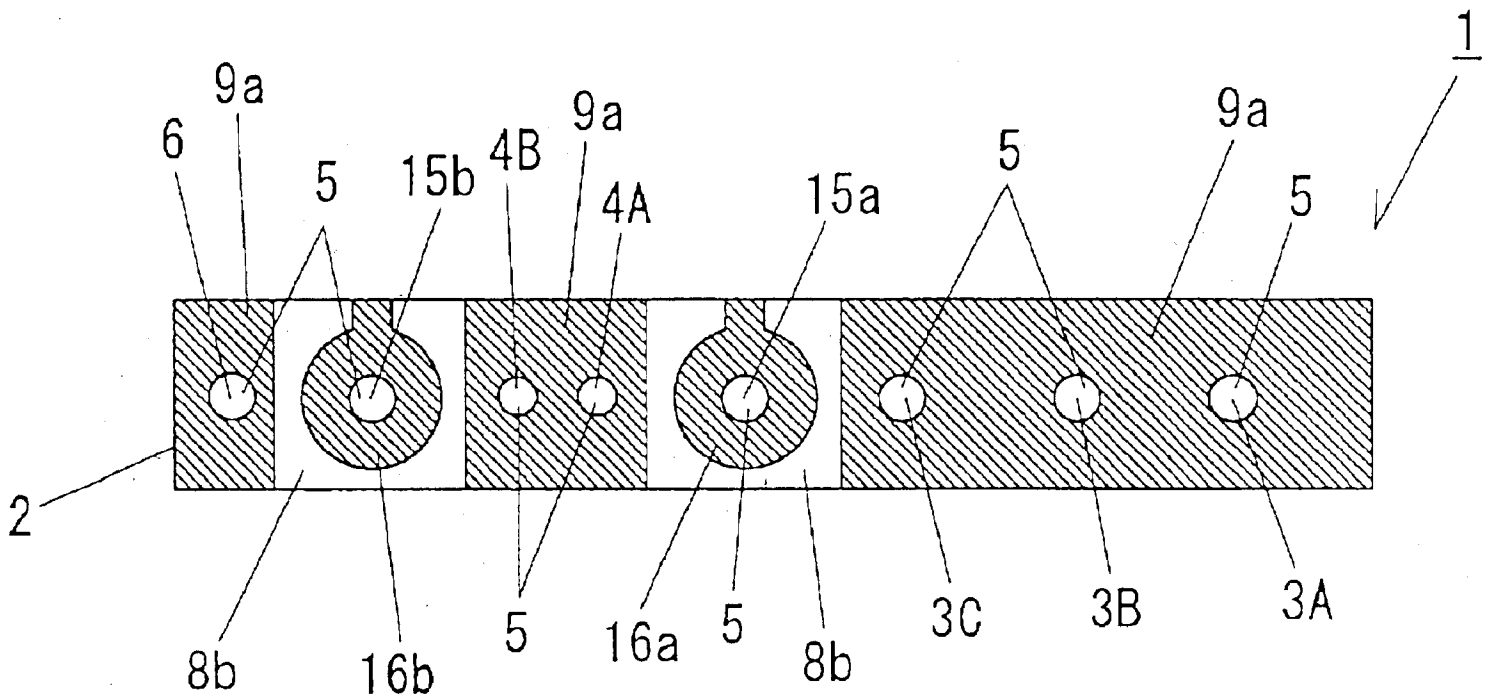
FIG. 3 is a bottom view of the dielectric duplexer of FIG. 1.

FIGS. 1 to 3 show a dielectric duplexer 1 in which eight through-holes 5, each coated with an internal conductor, are formed in a dielectric ceramic block 2 having a flat, rectangular parallelepiped shape. Referring to FIG. 2, the through-holes 5 will be described beginning with the rightmost. The three rightmost through-holes 5 serve as reception or receiving resonators denoted 3A–3C; the fourth through-hole 5 serves as an antenna excitation hole denoted 15*a*; the subsequent two through-holes 5 serve as transmission resonators denoted 4A and 4B; the seventh through-hole 5 serves as a transmission excitation hole denoted 15*b*; and the leftmost through-hole 5 serves as a trap formation resonator denoted 6. The resonators 3A–3C, 4A, 4B, and 6 are arranged in parallel with one another along a common axis to form a row within the dielectric ceramic block 2. It is noted that the resonators 3A, 3B, and 3C constitute a three-pole-type reception section R, whereas the resonators 4A and 4B constitute a two-pole-type transmission section T. The resonators 3A–3C, 4A, 4B, and 6 are of a length substantially corresponding to $\lambda/4$, where $\lambda$ is a wavelength corresponding to the predetermined resonant frequency of the resonators.

As is best seen in FIG. 1, an outer circumferential surface (i.e., a side surface) of the dielectric ceramic block 2 is coated with an external conductor 7, which serves as a shield electrode. Portions of an upper end face of the dielectric ceramic block 2 at which upper ends of the resonators 3A–3C, 4A, 4B, and 6 open, i.e., at which these ends terminate, serve as open circuit ends 8*a*, where the external conductor 7 is absent. Portions of a lower end face of the dielectric ceramic block 2 at which lower ends of the resonators 3A–3C, 4A, 4B, and 6 open or terminate, serve as short circuit ends 9*a*, where the external conductor 7 is present (see FIG. 3).

The antenna excitation hole 15*a* and the transmission excitation hole 15*b* formed between the resonators 3A–3C, 4A, 4B, and 6 are of an interdigital structure in relation to the resonators 3A–3C, 4A, 4B, and 6. Specifically, short circuit ends 9*b* for the excitation holes 15*a* and 15*b* are formed on the upper end face of the dielectric ceramic block 2, where the open ends 8*a* for the resonators 3A–3C, 4A, 4B, and 6 are provided, whereas open ends 8*b* for the excitation holes 15*a* and 15*b* are formed on the lower end face of the dielectric ceramic block 2, where the short circuit ends 9*a* for the resonators 3A–3C, 4A, 4B, and 6 are provided.

As shown in FIGS. 1 and 2, in the open ends 8*a*, a circular recess 10 is formed at the upper end of each of the through-holes 5, which constitute the resonators 3A–3C, 4A, 4B, and 6, in order to establish mutual coupling with an adjacent resonator. A circular extension conductor 11 is formed on the bottom surface of each of the recesses 10 and connected to the corresponding internal conductor.

As shown in FIG. 1, an antenna terminal pad 13 is formed, in spaced relation to the external conductor 7, on the side surface of the dielectric ceramic block 2 in the vicinity of the open end 8*b* for the antenna excitation hole 15*a*. As shown in FIG. 3, the antenna terminal pad 13 is connected to the excitation hole 15*a* via a connection conductor 16*a*. In this manner, the antenna terminal pad 13 is coupled with the innermost resonator 3C of the receiving or reception section R and the innermost resonator 4A of the transmission section T via the excitation hole 15*a*.

Similarly, an input terminal pad 12*t* (FIG. 1) is formed, in spaced relation to the external conductor 7, on the side surface of the dielectric ceramic block 2 in the vicinity of the open end 8*b* for the transmission excitation hole 15*b*. The input terminal pad 12*t* is connected to the excitation hole 15*b* via a connection conductor 16*b*. In this manner, the input terminal pad 12*t* is coupled with the transmission section T via the excitation hole 15*b*.

Further, an output terminal pad 12*r* of the receiving or reception section R is formed on the mounting surface (side surface) of the dielectric duplexer 1 spaced from the external conductor 7 at the greatest possible distance from the above-described antenna terminal pad 13. More specifically, the output terminal pad 12*r* is formed in spaced relation to the external conductor 7 in the vicinity of the open end 8*a*, while facing the outermost resonator 3A of the reception section R. With this arrangement, the output terminal pad 12*r* is capacitively coupled with the reception section R.

Next, a key feature of the invention will be described.

In accordance with the present invention, as shown in FIGS. 1 and 2, an electrode 20 for providing adjustment of the attenuation characteristics of duplexer 1 (hereinafter referred to as the "attenuation adjustment electrode" 20) is formed on the open end 8*a* for the resonators 3A to 3C of the reception section R so as to be located in the vicinity of the outermost resonator 3A. As shown in FIG. 2, the attenuation adjustment electrode 20 has a base conductor portion 21 connected to and extending from the output terminal pad 12*r* and having an arcuate edge concentric with the circular recess 10 formed at the upper end of the resonator 3A (i.e., concentric with the circular extension conductor 11 formed on the bottom surface of the recess 10), and adjustment conductor portions 22 projecting, as shown, in opposite directions from the base conductor portion 21 along the path or direction of the row or arrangement of the resonators 3A–3C, 4A, 4B, and 6.

As illustrated in FIG. 2, the adjustment conductor portions 22 include a first adjustment conductor portion 22*a* and a second adjustment conductor portion 22*b*. The first adjustment conductor portion 22*a* projects from the base conductor portion 21 toward the center of the upper face of the dielectric ceramic block 2 along the path of the arrangement of the resonators 3A–3C, 4A, 4B, and 6, whereas the second adjustment conductor portion 22*b* projects from the base conductor portion 21 toward the outside of the upper face of the dielectric ceramic block 2 along the path of the arrangement of the resonators 3A–3C, 4A, 4B, and 6.

Figure 4A:
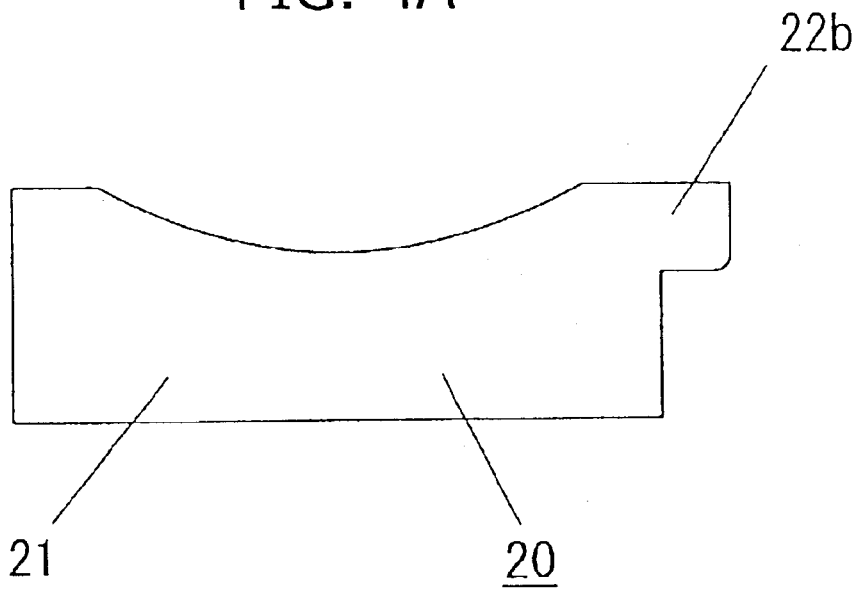
Figure 4B:
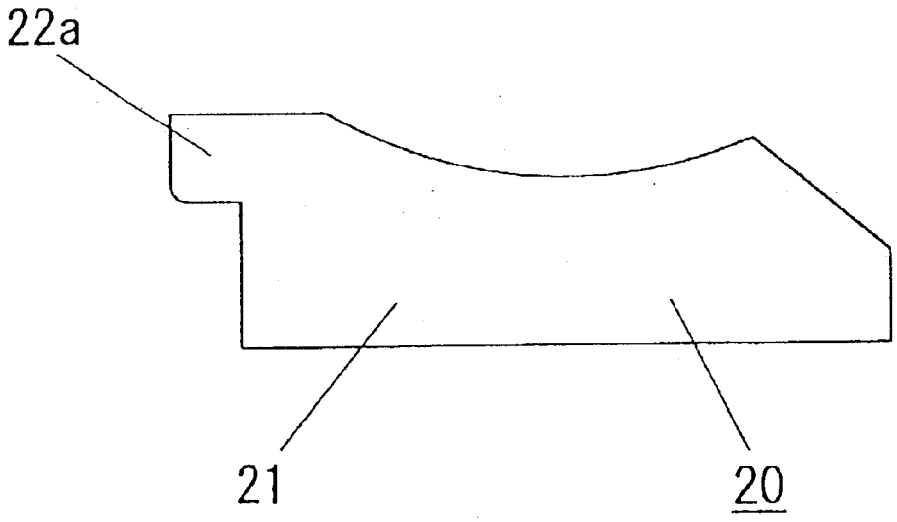

From the results of various experiments, the present inventors have confirmed that the attenuation characteristics of the dielectric duplexer 1 change when the adjustment conductor portions 22 of the attenuation adjustment electrode 20 are ground away by predetermined amounts, i.e., when different amounts thereof are removed. Moreover, referring to FIGS. 4A and 4B, the present inventors have found that the attenuation characteristics change in a different manner depending on whether the first adjustment conductor portion 22*a* is ground away or otherwise removed (as shown in FIG. 4A) or the second conductor portion 22*b* is ground away or otherwise removed (as shown in FIG. 4B). The results of such experiments will be described below.

Figure 5A:
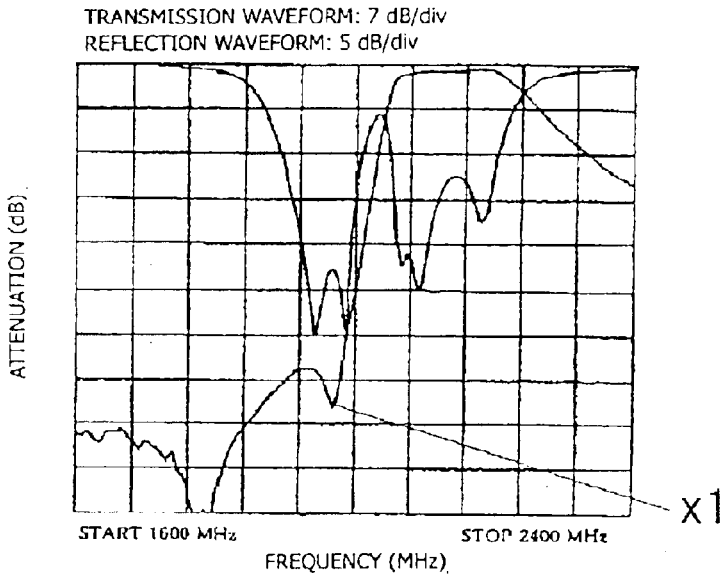
Figure 5B:
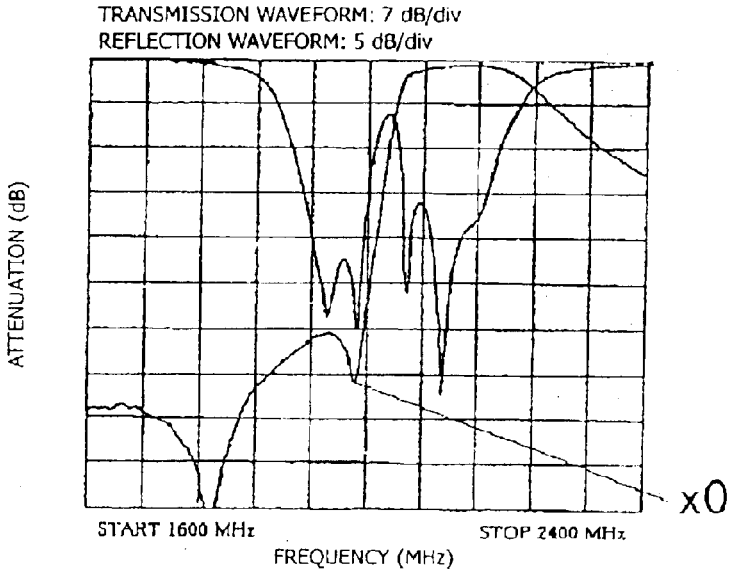

FIG. 5A shows the attenuation characteristics of the dielectric duplexer 1 for the case where the first adjustment conductor portion 22*a* was ground down or otherwise removed. The attenuation characteristics of FIG. 5A include an attenuation peak denoted x1. On the other hand, FIG. 5B shows the attenuation characteristics of the dielectric duplexer 1 for the case where the attenuation adjustment electrodes 22 were not ground down at all, i.e., when electrodes 22 are undisturbed and thus were of the shape shown in FIGS. 1 and 2. The attenuation characteristics of FIG. 5B include an attenuation peak denoted x0. A comparison between the attenuation peaks x0 and x1 shows that the attenuation peak x0 is shifted toward the lower frequency side of the frequency characteristic, through grinding away of the first adjustment conductor portion 22*a*.

Figure 6A:
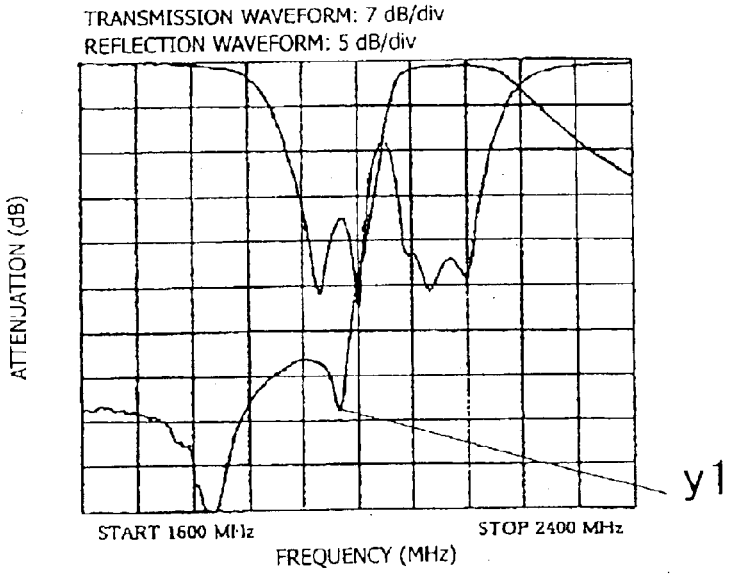
Figure 6B:
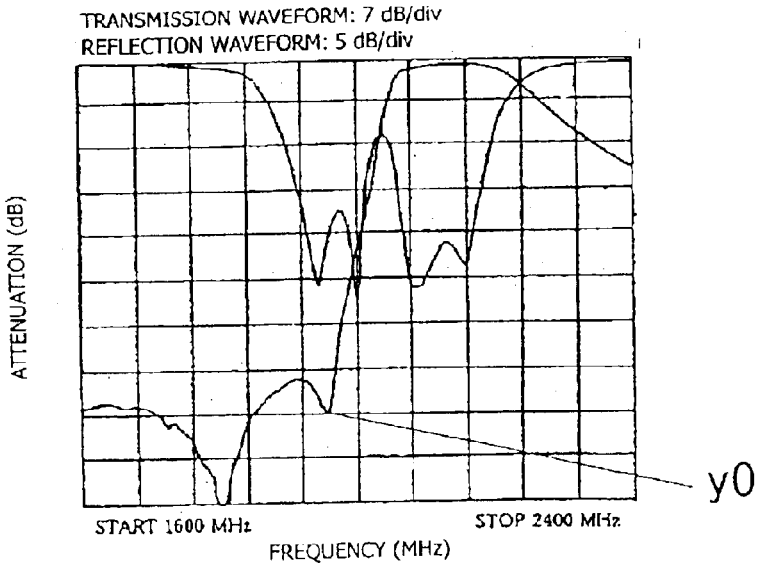

In contrast, FIG. 6A shows the attenuation characteristics of the dielectric duplexer 1 for the case where the second adjustment conductor portion 22*b* was ground away or otherwise removed. The attenuation characteristics of FIG. 6A include an attenuation peak denoted y1. FIG. 6B shows the attenuation characteristics of the dielectric duplexer 1 for the case where the attenuation adjustment electrodes 22 were not ground away at all and thus are of the shape shown in FIGS. 1 and 2. The attenuation characteristics of FIG. 6B include an attenuation peak denoted y0. A comparison between the attenuation peaks y0 and y1 shows that the attenuation peak y0 is shifted toward the higher frequency side through grinding away of the second adjustment conductor portion 22*b*.

As is confirmed by the above-described experimental results, the present inventors have invented a method of adjusting the attenuation characteristics of the dielectric duplexer 1 in which the attenuation peak x0 is shifted toward the lower frequency side by grinding away the first adjustment conductor portion 22*a*, and the attenuation peak y0 is shifted toward the higher frequency side by grinding way the second adjustment conductor portion 22*b*. Because the above-described configuration enables easy determination of the amount and position of grinding required for obtaining desired attenuation characteristics, the attenuation characteristics of the dielectric duplexer 1 can be quickly adjusted in the manner desired.

It is further noted that when one of the adjustment conductor portions 22*a* and 22*b* is ground excessively, i.e., when too much thereof is removed, this can be compensated for by grinding away a predetermined amount of the other of the adjustment conductor portions 22*a* and 22*b*.

It will be understood that while the present invention was described above in relation to a dielectric duplexer device, the invention can be applied to dielectric filters and other dielectric electronic components. Further, the attenuation adjustment electrode of the present invention may be provided for any terminal pad. Thus, as mentioned previously, the present invention is not limited to the above-described embodiment, but rather encompasses other embodiments wherein attenuation characteristics are adjusted by means of grinding away or otherwise removing a portion or portions of the attenuation adjustment electrode.

Accordingly, although the invention has been described above in relation to preferred embodiments thereof, it will be understood by those skilled in the art that variations and modifications can be effected in these preferred embodiments without departing from the scope and spirit of the invention.

What is claimed is:

1. A dielectric electronic component comprising:

a dielectric ceramic block;

a plurality of resonators arranged in a row in the dielectric ceramic block, each of said resonators comprising an internal conductor disposed on a wall surface of a through-hole formed in the dielectric ceramic block;

an external conductor disposed on a side surface of the dielectric ceramic block;

at least one terminal pad formed on the side surface of the dielectric ceramic block in spaced relation to the external conductor and coupled with a predetermined resonator of said plurality of resonators; and an attenuation adjustment electrode provided on an end face of the dielectric ceramic block, said end face providing an open circuit end for said resonators, and said attenuation adjustment resonator being disposed in spaced relation to one end of said predetermined resonator, the attenuation adjustment electrode including a base conductor portion connected to and extending from the terminal pad and having an edge facing said end of said predetermined resonator, and at least one adjustment conductor portion projecting from the base conductor portion substantially laterally thereof.

2. A dielectric electronic component according to claim 1, wherein the attenuation adjustment electrode comprises first and second adjustment conductor portions projecting substantially laterally from the base conductor portion in opposite directions in such a manner that the first adjustment conductor portion extends toward a center part of said end face of the block, and the second adjustment conductor portion extends toward an outside part of said end face of the block.

3. A dielectric electronic component according to claim 1, wherein the predetermined resonator includes a circular extension conductor provided at said end of the predetermined resonator and connected thereto, and wherein the base conductor portion of the attenuation adjustment electrode has an arcuate edge concentric with said circular extension conductor.

4. A method for adjusting attenuation characteristics of a dielectric electronic component comprising a dielectric ceramic block; a plurality of resonators arranged in a row in the dielectric ceramic block, each of said resonators comprises an internal conductor disposed on a wall surface of a through-hole formed in the dielectric ceramic block; and an external conductor disposed on a side surface of the dielectric ceramic block; at least one terminal pad formed on the side surface of the dielectric ceramic block in spaced relation to the external conductor and coupled with a selected resonator of said plurality of resonators, said method comprising the steps of:

forming an attenuation adjustment electrode on an end face of the dielectric ceramic block that provides an open circuit end for the resonators in such a manner that the attenuation adjustment electrode is located in spaced relation to one end of the selected resonator, and comprises a base conductor portion extending from the terminal pad and having an edge that faces the end of the selected resonator, and at least one adjustment conductor portion projecting from the base conductor portion substantially laterally thereof; and selectively removing part of the adjustment conductor portion of the attenuation adjustment electrode to thereby adjust attenuation characteristics of the dielectric electronic component.

5. A method according to claim 4 wherein the step of selectively removing part of said adjustment conductor portion comprises grinding away said part.

6. A method of adjusting attenuation characteristics of a dielectric electronic component according to claim 5, wherein the forming step comprises forming first and second adjustment conductor portions projecting substantially laterally from the base conductor portion in opposite directions in such a manner that the first adjustment conductor portion extends toward a center part of said end face of the block, and the second adjustment conductor portion extends toward an outside part of said end face of the block; and the grinding away step comprises grinding away at least part of the first adjustment conductor portion in order to shift an attenuation peak toward the lower frequency side, and grinding away at least part of the second adjustment conductor portion in order to shift the attenuation peak toward the higher frequency side.

7. A method of adjusting attenuation characteristics of a dielectric electronic component according to claim 4, wherein the selected resonator has a circular extension conductor connected to one end of the selected resonator; and the attenuation adjustment electrode is formed in such a manner that the base conductor portion of the attenuation adjustment electrode has an arcuate edge concentric with said circular extension conductor.

8. A dielectric duplexer comprising:

a dielectric ceramic block;

a plurality of resonators arranged in a row in the dielectric ceramic block, the resonators each comprising an internal conductor disposed on a wall surface of a through-hole formed in the dielectric ceramic block, and being divided into first and second groups such that said first group serves as a transmission section and said second group serves as a reception section;

an external conductor disposed on a side surface of the dielectric ceramic block;

an input terminal pad formed on said side surface of the dielectric ceramic block in spaced relation to the external conductor and so as to be coupled with the transmission section;

an output terminal pad formed on said side surface of the dielectric ceramic block in spaced relation to the external conductor and so as to be coupled with the reception section;

an antenna terminal pad formed on said side surface of the dielectric ceramic block in spaced relation to the external conductor and so as to be coupled with an innermost resonator of the transmission section and an innermost resonator of the reception section; and an attenuation adjustment electrode provided on an end face of the dielectric ceramic block, said end face providing an open circuit end for the resonators of the reception section, and attenuation adjustment electrode being disposed in spaced relation to one end of an outermost resonator of the reception section, the attenuation adjustment electrode including a base conductor portion extending from the output terminal pad and having an edge that faces said one end of the outermost resonator, and at least one adjustment conductor portion projecting from the base conductor portion substantially laterally thereof.

9. A dielectric duplexer according to claim 8, wherein the attenuation adjustment electrode comprises first and second adjustment conductor portions projecting substantially laterally from the base conductor portion in opposite directions in such a manner that the first adjustment conductor portion extends toward a center part of said end face of the block, and the second adjustment conductor portion extends toward an outside part of said end face of the block.

10. A dielectric duplexer according to claim 8, wherein the outermost resonator of the reception section includes a circular extension conductor provided at the one end of the outermost resonator and connected thereto and wherein the base conductor portion of the attenuation adjustment electrode has an arcuate edge concentric with said circular extension conductor.

11. A method of adjusting attenuation characteristics of a dielectric duplexer comprising a dielectric ceramic block; a plurality of resonators arranged in a row in the dielectric ceramic block, the resonators each comprising an internal conductor disposed on a wall surface of a through-hole formed in the dielectric ceramic block, and being divided into first and second groups such said first group serves as a transmission section and said second group serves as a reception section; an external conductor covering a side surface of the dielectric ceramic block; an input terminal pad disposed on said side surface of the dielectric ceramic block in spaced relation to the external conductor and so as to be coupled with the transmission section; an output terminal pad formed on said side surface of the dielectric ceramic block in spaced relation to the external conductor and so as to be coupled with the reception section; and an antenna terminal pad formed on said side surface of the dielectric ceramic block in spaced relation to the external conductor and so as to be coupled with an innermost resonator of the transmission section and an innermost resonator of the reception section, the method comprising the steps of:

forming an attenuation adjustment electrode on an end face of the dielectric ceramic block that provides an open circuit end for the resonators of the reception section in such a manner that the attenuation adjustment electrode is located in spaced relation to one end of an outermost resonator of the reception section, and has a base conductor portion extending from the output terminal pad and having an edge that faces the end of the outermost resonator, and at least one adjustment conductor portion projecting from the base conductor portion substantially laterally thereof; and selectively removing the adjustment conductor portion of the attenuation adjustment electrode to thereby adjust attenuation characteristics of the dielectric duplexer.

12. A method according to claim 11 wherein the step of selectively removing part of said adjustment conductor portion comprises removing said part in a grinding step.

13. A method of adjusting attenuation characteristics of a dielectric duplexer according to claim 11, wherein the forming step comprises forming first and second adjustment conductor portions projecting substantially laterally from the base conductor portion in opposite directions in such a manner that the first adjustment conductor portion extends toward a center part of said end face of the block, and the second adjustment conductor portion extends toward an outside part of said end face of the block; and the grinding step comprises grinding away at least part of the first adjustment conductor portion in order to shift an attenuation peak toward the lower frequency side, and grinding away at least part of the second adjustment conductor portion in order to shift the attenuation peak toward the higher frequency side.

14. A method of adjusting attenuation characteristics of a dielectric duplexer according to claim 11, wherein the outermost resonator of the reception section has a circular extension conductor provided at one end of the outermost resonator and connected thereto; and the attenuation adjustment electrode is formed in such a manner that the base conductor portion of the attenuation adjustment electrode has an arcuate edge concentric with said circular extension conductor.

* * * * *